United States Patent [19]

Wonn et al.

[11] Patent Number: 4,502,046

[45] Date of Patent: Feb. 26, 1985

[54] SYSTEM FOR MONITORING METAL-TO-METAL CONTACT IN ROTATING MACHINERY

[75] Inventors: James W. Wonn, Hempfield Township, Westmoreland County; Robert L. Osborne, Wallingford, both of Pa.

[73] Assignee: Westinghouse Electric Corp., Pittsburgh, Pa.

[21] Appl. No.: 383,400

[22] Filed: Jun. 1, 1982

[51] Int. Cl.[3] ..... G08B 21/00

[52] U.S. Cl. ..... 340/682; 73/116; 415/118; 340/679

[58] Field of Search ..... 340/682, 679; 73/116, 73/660; 415/118

[56] References Cited

U.S. PATENT DOCUMENTS

| | | | |
|---|---|---|---|
| 2,879,470 | 3/1959 | Wright, Jr. | 73/660 X |
| 3,146,434 | 8/1964 | Sharples . | |
| 3,183,043 | 5/1965 | Creeger et al. . | |
| 3,508,241 | 4/1970 | Potter . | |
| 3,649,787 | 3/1972 | Kasabian . | |
| 3,677,072 | 7/1972 | Weichbrodt et al. . | |
| 3,775,680 | 11/1973 | Egeland . | |
| 3,897,116 | 7/1975 | Carpenter . | |
| 3,904,940 | 9/1975 | Burrus | 340/682 |
| 3,981,621 | 9/1976 | Considine . | |
| 3,991,413 | 11/1976 | Berger . | |
| 4,063,786 | 12/1977 | Rall . | |
| 4,209,779 | 1/1980 | Beck . | |
| 4,237,454 | 12/1980 | Meyer . | |
| 4,262,538 | 4/1981 | Otawara | 73/660 X |
| 4,379,291 | 4/1983 | Hubbard | 340/682 |

FOREIGN PATENT DOCUMENTS

| | | | |
|---|---|---|---|
| 786989 | 6/1968 | Canada | 340/679 |

*Primary Examiner*—Glen R. Swann, III
*Attorney, Agent, or Firm*—D. Schron

[57] ABSTRACT

A rub between the rotating and stationary parts of a turbine is detected by connecting the rotor to electrical ground and introducing electrical energy into the rotor-ground circuit. A rub between the rotating stationary part modifies the currents in the grounding circuit to an extent that the condition may be detected so as to provide a rub indication. In another embodiment the rotor discharge current in one or more grounding devices normally associated with a turbine is monitored to detect any abnormal condition.

14 Claims, 9 Drawing Figures

FIG. 1
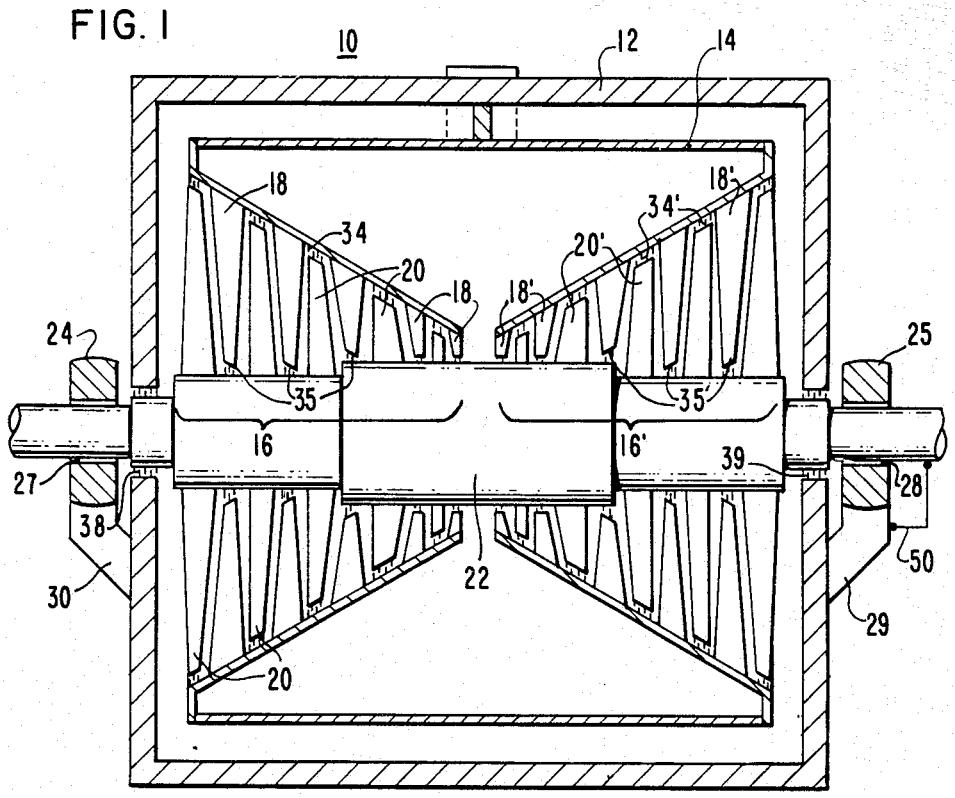
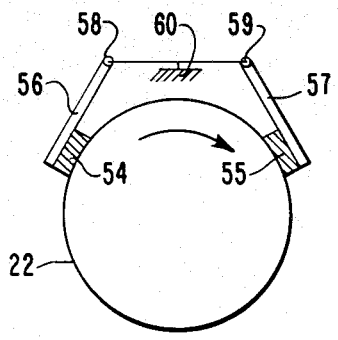
FIG. 2A
FIG. 2B
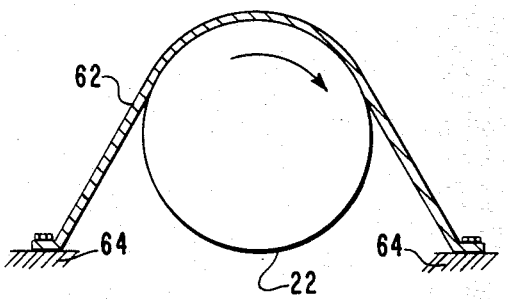

FIG. 3
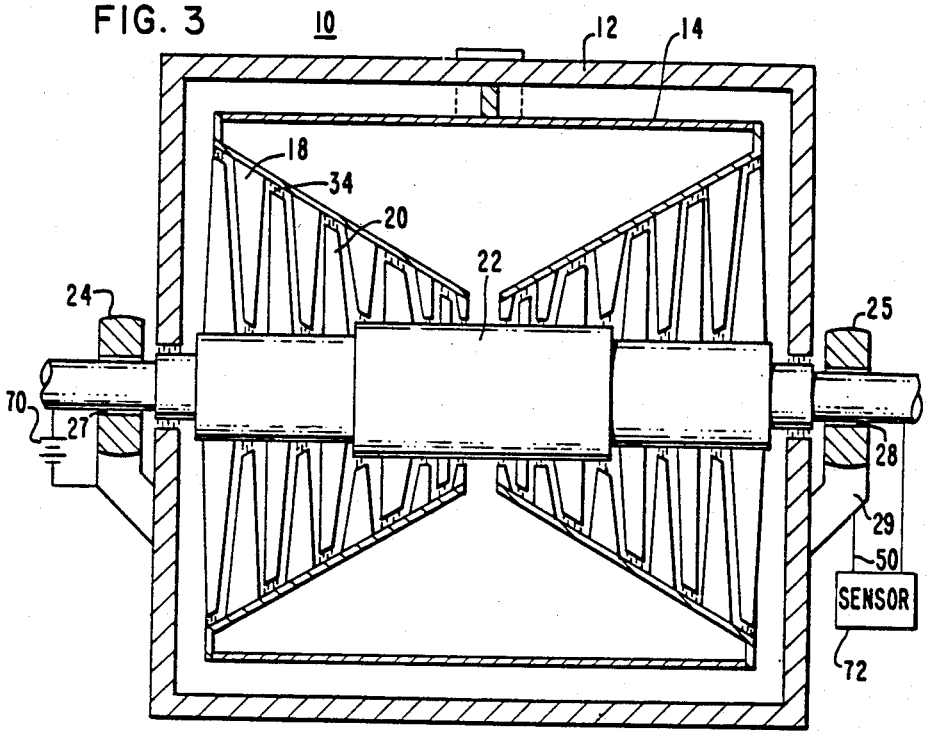
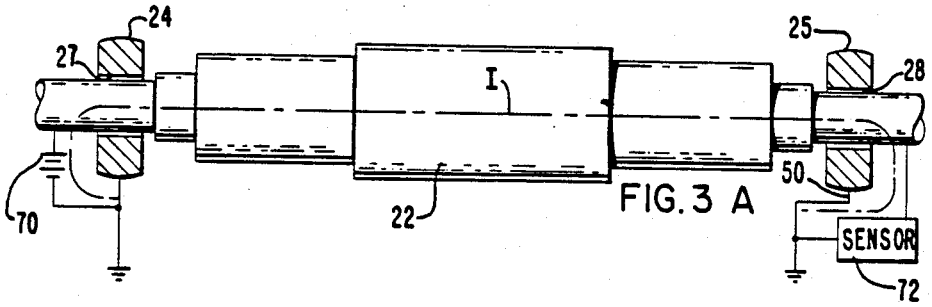
FIG. 3 A
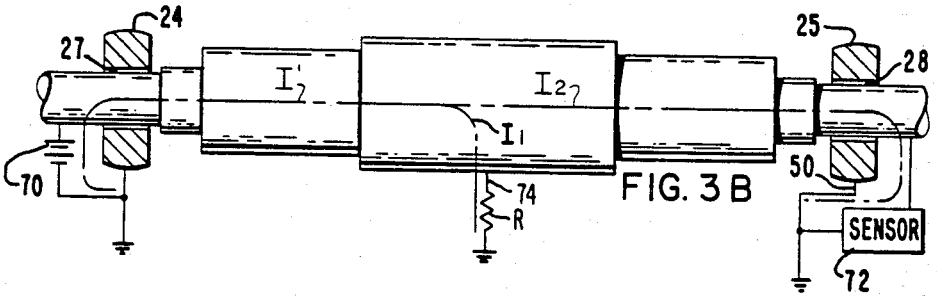
FIG. 3 B

SYSTEM FOR MONITORING METAL-TO-METAL CONTACT IN ROTATING MACHINERY

BACKGROUND OF THE INVENTION

1. Field of the Invention

The invention in general relates to monitoring systems, and particularly to apparatus for detecting undesired metal-to-metal contact between a rotary part and a stationary part of a rotary machine.

2. Description of the Prior Art

In rotating machinery a problem often arises wherein the rotating portion of the machinery contacts the stationary portion thus creating an unwanted and potentially dangerous rubbing condition. For example, in a steam turbine various steam seals exist in order to prevent steam leakage between blade rows as well as to prevent leakage where the rotor penetrates the outer cylinder of the turbine. A mechanical or thermal condition may occur whereby distortion or abnormal operation of the turbine parts may cause one or more of the seals or blades of the turbine to rub thus resulting in a potentially dangerous situation.

The presence of a rub will cause certain abnormal vibrations to occur in the turbine and generally a plurality of vibration sensors are mounted at various points on the turbine system to monitor such vibrations. Other techniques for monitoring rubs include the use of particular sensors for detecting the occurrence of acoustic emissions within the metal parts of the turbine, such acoustic emissions being generated as a result of certain abnormal operating conditions.

A problem arises, however, in the use of acoustic emission or vibration sensing techniques in that it is very often impossible to differentiate between a rub condition as opposed to other conditions relative to the turbine rotor, bearings, etc. which may provide signals similar to those provided by a rub condition.

The present invention may be used by itself or in conjunction with prior art techniques to determine the presence of an unwanted rub in rotating machinery.

SUMMARY OF THE INVENTION

A rotating machine in which rubs are to be detected including a stationary machine assembly and a rotating assembly which rotates relative to it. Electrical means are provided connecting the stationary and rotating assemblies for establishing an electric current discharge path between them so that both assemblies are at the same reference potential, for example, ground. Means are further provided for detecting modifications of the current in the discharge path.

The rotating assembly may include a rotor supported at spaced-apart locations by respective first and second bearing members of the type which normally electrically insulate the rotor from the stationary assembly. Means such as a grounding device electrically connects the rotor with the stationary assembly in the vicinity of the first bearing member as well as the second bearing member. At least one of the grounding devices includes means for detecting other than normal discharge currents in the device. In the preferred embodiment active electrical means are inserted in electrical circuit relationship with at least one of the grounding devices for injecting electrical energy into the rotor during its normal operation. Sensing means detects the injected electrical energy and if a rub condition should occur affording an alternate current path to ground, the condition will manifest itself by significantly altering the sensor reading.

BRIEF DESCRIPTION OF THE DRAWINGS

FIG. 1 is a simplified sectional view of a rotating machine in the form of a turbine;

FIGS. 2A and 2B illustrate, in somewhat more detail, typical grounding arrangements for the turbine of FIG. 1;

FIG. 3 illustrates one embodiment of the present invention;

FIGS. 3A and 3B reproduce a portion of FIG. 3 and respectively illustrate current paths in the absence and presence of a rub.

DESCRIPTION OF THE PREFERRED EMBODIMENT

Figure 4:
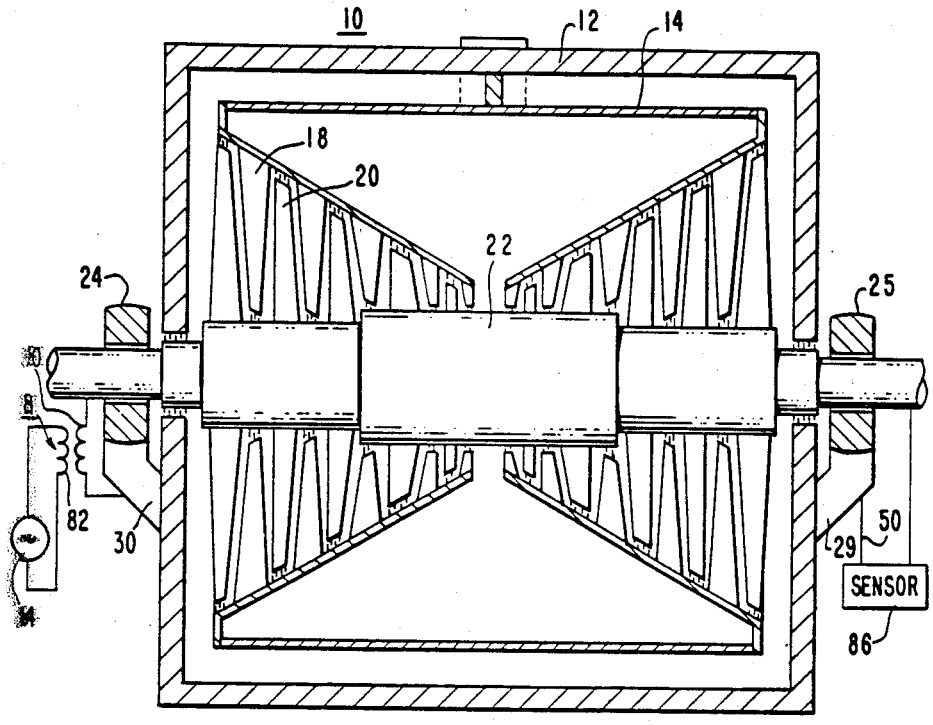
FIGS. 4–6 are views as in FIG. 1, further illustrating different embodiments of the present invention.

Although the invention is applicable to a variety of rotating machine arrangements, it will be described, by way of example, with respect to a turbine structure, and particularly to a steam turbine as depicted in FIG. 1.

The turbine 10 is comprised of a stationary assembly including an outer casing 12 commonly referred to as an outer cylinder, and an inner structure 14 commonly referred to as an inner cylinder and which is structurally connected to the outer cylinder 12. Various turbine designs may include multiple inner cylinders.

Steam enters the double-flow design depicted and steam expansion simultaneously takes place through turbine blade stages 16 and 16'. Blades 18 (and their primed counterparts) are stationary blades connected to the inner cylinder 14 whereas blades 20 (and their primed counterparts) are connected to rotor 22 and constitute rotor blades.

Rotor 22 is supported at first and second spaced-apart locations by respective bearings 24 and 25 both of which are of the journal-bearing type wherein rotor 22 is supported and rotates on a thin film of oil as depicted by numeral 27 in bearing 24 and by numeral 28 in bearing 25. The bearings themselves are supported on respective pedestal structures depicted by reference numerals 29 and 30.

In order to minimize steam leakage between blade rows, many turbines include some sort of sealing arrangement for the blades. Thus, a labyrinth type seal 34 is illustrated as the steam seal arrangement between the rotor blades 20 and inner casing 14, whereas labyrinthtype seals 35 are illustrated between the stationary blades 18 and rotor 22. Further, seals 38 and 39 are provided at the points where the rotor penetrates the outer cylinder so as to prevent leakage of air into, or steam from, the cylinders.

Due to its operating environment, a rotor 22 tends to build up an electrostatic charge and since the rotor is electrically isolated from the stationary assembly, a potentially dangerous voltage differential may build up across the oil film 27, 28, supporting the rotor. If the electrical rating of the thin film of oil is exceeded, an electric discharge may take place therethrough causing an arc-over which if continued, may result in burning of the lubricating oil, pitting, turbulence, and eventual bearing damage. In order to obviate this potentially dangerous condition, means are generally provided for maintaining the rotor 22 at the same electrical potential, generally ground, as the stationary assembly 12. This is accomplished with the provision of a grounding device 50 electrically connecting the rotor 22 to a pedestal structure 29 (or any other stationary portion of the turbine) so as to establish an electric current discharge path between the rotary and stationary portions of the machine. Typical grounding arrangements are illustrated by way of example in FIGS. 2A and 2B to which reference is now made.

In FIGS. 2A the grounding device is comprised of a pair of electrically conducting brushes 54 and 55 such as carbon-graphite carried by respective metallic brush holders 56 and 57 pivotable around dowels 58 and 59, with the brushes being spring-loaded against the rotating shaft 22 and being electrically, connected to ground indicated by numeral 60, so that any electrostatic charge built up on the turbine rotor may be carried to ground through the brushes and their respective holders.

Another type of grounding arrangement is illustrated in FIG. 2B and includes a grounding strap 62 of metallic braid which electrically contacts the rotor 22 as well as ground, indicated by numeral 64.

In one embodiment of the present invention the grounding arrangement as illustrated in FIG. 1 is modified so that an electric current is injected into the rotor/ground circuit and monitored such that if a rub does occur affording an alternate current path to ground, the monitoring device will so indicate. One arrangement is illustrated in FIG. 3.

In FIG. 3 a DC source of electrical energy as represented by battery 70 is electrically connected in circuit between rotor 22 and machine ground by virtue of its connection to pedestal structure 30, by way of example. Grounding device 50 at the other end of the rotor has been modified to include a sensor 72 connected in circuit between the rotor and the ground and in one embodiment may include a DC ammeter.

A simplified electrical representation of the arrangement of FIG. 3 is illustrated in FIG. 3A. Battery 70 establishes a current I in the rotor 22 and this current I is detected by sensor 72 in its path to ground. No current path is established through bearings 24 or 25 since they are insulated from ground by virtue of the thin oil film 27 and 28.

If a rub should occur, the rotating assembly will be in electrical contact with the stationary assembly somewhere between the bearings. This situation is depicted in FIG. 3B wherein numeral 74 and resistor R represents the alternate current path to ground. The current I' provided by battery 70 now is divided ($I_1$ and $I_2$) between the alternate path to ground and the previous path to ground through sensor 72. A change in normal operating current is then detected by sensor 72 which may include means for providing an alarm signal if the current value therethrough differs by a predetermined amount from a previously established normal value.

FIG. 4 illustrates an embodiment similar in concept to that illustrated in FIG. 3, but using alternating current. Secondary winding 80 of transformer 81 is connected in circuit between the rotor 22 and ground by virtue of its connection to pedestal structure 30. Primary winding 82 of transformer 81 is connected to receive the energy provided by an AC signal source 84, the arrangement having the effect of injecting an AC signal into rotor 22. At the opposite end of rotor 22 there is positioned sensor 86 which, for the embodiment of FIG. 4, includes means for detecting the AC current together with means for providing an output alarm signal should the current deviate by a predetermined amount from a preset value.

Figure 5:
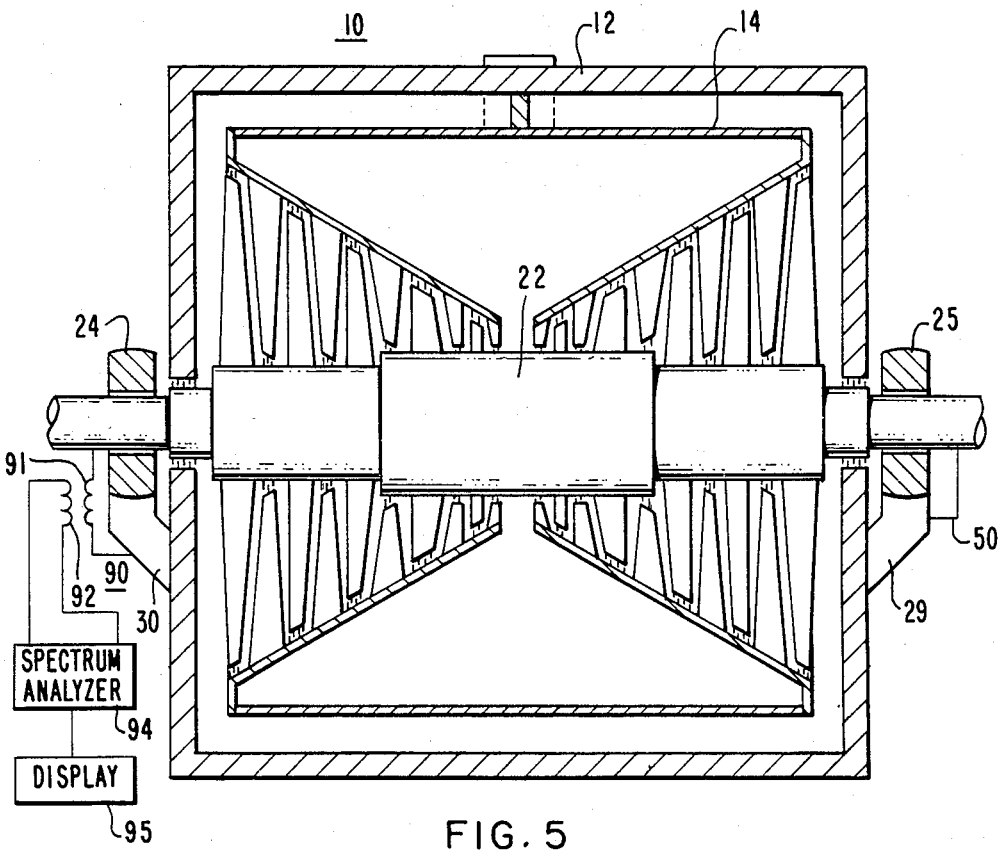

In the embodiment of FIG. 5 the grounding device 50 at one end of rotor 22 remains unmodified while at the other end thereof means are provided for establishing a resonant excitation frequency. More particularly, at some AC frequency the current path length through rotor 22 and the stationary assembly 12 will equal one electrical wavelength and the current loop will become resonant. This resonant condition can be sensed by observing current and voltage relationships at the driving point and the existence of a rub would cause a change in the distribution of current which would cause a detectable change in the resonant frequency.

One way of accomplishing this is with the provision of transformer 90 having a secondary winding 91 connected in circuit between the rotor 22 and pedestal structure 30. The primary winding 92 of the transformer is connected to a swept-frequency network impedance analyzer 94 which measures the relatinship between current and voltage in the loop current circuit as a function of frequency. Frequencies of parallel and series loop resonance can be associated with maximum and minimum impedance frequencies, respectively. A typical swept-frequency network impedance analyzer may include a display 95 which will provide a visual readout of the resonant frequency. Additionally, means may be included for providing an indication as to when the resonant frequency deviates by a predetermined amount, such deviation being caused by a rub resulting in a consequent change of the previously established resonant frequency.

Figure 6:
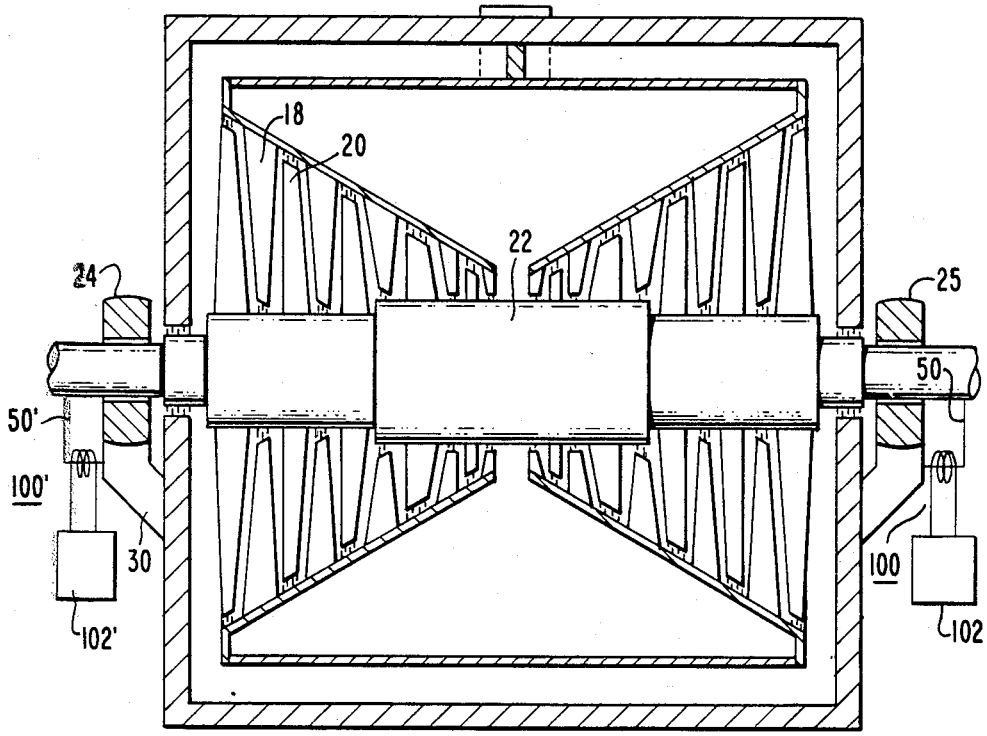

In the embodiment of FIG. 6 the grounding device 50 remains unmodified except for the provision of a current transformer 100 which is operable to sense the normal discharge current in the grounding device and provide such indication to a sensor 102. The sensor device 102 for the embodiment of FIG. 6 would include means such as an rsm volt meter to detect a sudden decrease in average electrical noise power level, such decrease being caused by a rub, and providing such indication to an alarm circuit. In order to provide a more positive indication of such rub an additional grounding device 50' together with current transformer 100' and sensor 102' are provided at the other end of rotor 22.

Accordingly, there has been described apparatus which can detect rubs in rotating machinery such as turbines and which accomplishes such objective with the state of the art equipment in a relatively simple manner. The apparatus may be used alone for detecting rubs and may also be used in conjunction with other detecting means such as vibration detectors as a positive indication of certain rubbing malfunctions.

We claim:

1. Apparatus for detecting rubs in rotating machinery, comprising (A) a stationary machine assembly;

(B) a rotating assembly, rotatable relative to said stationary assembly;

(C) electrical means continuously connecting said stationary and rotating assemblies for establishing an electric current discharge path between them, and (D) means for detecting deviations of the current in said discharge path with respect to a pre-established normal.

2. Apparatus according to claim 1 wherein:

(A) said rotating assembly is supported at first and second spaced-apart locations by respective first and second journal bearings.

3. Apparatus according to claim 2 wherein:

(A) said electrical means and means for detecting are electrically connected to at least one of said journal bearings.

4. Apparatus according to claim 2 wherein:

(A) said electrical means and means for detecting are respectively electrically connected to both of said journal bearings.

5. Apparatus for detecting rubs in rotating machinery, comprising (A) a stationary machine assembly;

(B) a rotating assembly rotatable relative to said stationary assembly and supported at first and second spaced-apart locations by journal bearings;

(C) a source of electrical energy connected between said stationary and rotating assemblies to establish an electrical current through said rotating assembly;

(D) means connected between said stationary and rotating assemblies to complete a current path for said electrical current;

(E) sensor means for detecting the current in said current path for establishing any deviation with respect to a pre-established normal.

6. Apparatus according to claim 5 wherein:

(A) said source of electrical energy is located at said first location; and (B) said means is located at said second location.

7. Apparatus according to claim 5 wherein:

(A) said source of electrical energy is a DC source; and (B) said sensor means includes means for detecting a direct current.

8. Apparatus according to claim 5 wherein:

(A) said source of electrical energy is an AC source; and (B) said sensor means includes means for detecting an alternating current.

9. Apparatus according to claim 5 wherein:

(A) at some AC frequency the current path length through said rotating assembly and said stationary assembly will equal one electrical wavelength of said frequency to define an electrical resonant frequency;

(B) said source of electrical energy includes a signal generator operable to provide a plurality of different frequency signals, at least one of which is equivalent to said electrical resonant frequency; and (C) said sensor means includes means for detecting any change in said electrical resonant frequency.

10. In a turbine installation having an outer casing, a plurality of stationary blades within said casing, a rotor member including plurality of rotor blades adapted for movement relative to said stationary blades, with said rotor being supported by journal bearings at spaced-apart locations, apparatus for detecting rubs between the rotor member and the casing and/or bearings, comprising:

(A) a grounding device for electrically connecting said rotor member with said casing;

(B) means for injecting a current into said rotor member;

(C) means operatively connected to said grounding device for detecting current therethrough.

11. Apparatus according to claim 10 wherein said means for injecting includes (A) a source of electrical energy coupled between said rotor member and said casing at a position spaced from said grounding device and operable to supply an electric current to said rotor member.

12. Apparatus according to claim 11 wherein:

(A) said source of electrical energy is a DC source.

13. Apparatus according to claim 11 wherein:

(A) said source of electrical energy is an AC source.

14. A method of detecting rubs in rotating machinery having a rotating assembly and a stationary assembly electrically isolated therefrom comprising the steps of:

(A) establishing an electrically conducting path between said rotating and stationary assemblies;

(B) introducing an electrical current into said rotating assembly; and (C) obtaining an indication of the current in said path.

* * * * *

Disclaimer 4,502,046.—*James W. Wonn,* Hempfield Township, Westmoreland County and *Robert L. Osborne,* Wallingford, both of Pa. SYSTEM FOR MONITORING METAL-TO-METAL CONTACT IN ROTATING MACHINERY. Patent dated Feb. 26, 1985. Disclaimer filed Feb. 14, 1986, by the assignee, *Westinghouse Electric Corp.*

Hereby enters this disclaimer to claims 1 to 4 of said patent.

[*Official Gazette April 8, 1986.*]